US007010139B1

(12) United States Patent
Smeehuyzen

(10) Patent No.: US 7,010,139 B1
(45) Date of Patent: Mar. 7, 2006

(54) BONE CONDUCTING HEADSET APPARATUS

(76) Inventor: Kees Smeehuyzen, P.O. Box 546, Delray Beach, FL (US) 33447

( * ) Notice: Subject to any disclaimer, the term of this patent is extended or adjusted under 35 U.S.C. 154(b) by 133 days.

(21) Appl. No.: 10/725,759

(22) Filed: Dec. 2, 2003

(51) Int. Cl.
*H04R 25/00* (2006.01)

(52) U.S. Cl. ..... 381/380; 381/376

(58) Field of Classification Search ..... 381/370, 381/371, 372, 373, 374, 375, 376, 377, 378, 381/379, 380, 182
See application file for complete search history.

(56) References Cited

U.S. PATENT DOCUMENTS 4,791,673 A * 12/1988 Schreiber ..... 381/151
5,511,132 A * 4/1996 Yoshimi ..... 381/386
6,456,721 B1 9/2002 Fukuda ..... 381/380

FOREIGN PATENT DOCUMENTS

JP 11-215581 * 8/1999

* cited by examiner

*Primary Examiner*—Sinh Tran
*Assistant Examiner*—Brian Ensey
(74) *Attorney, Agent, or Firm*—Sturm & Fix LLP

(57) ABSTRACT

A bone conducting headset apparatus (10) that includes a pair of speaker/microphone members (30) (30) mounted at the juncture of a head strap (21) and a neck strap (22) provided with a spring biasing member (23) wherein, the speaker/microphone members (30) (30) are operatively connected to an electronic control member (40) that is provided with means (46) for selectively attaching the electronic control member (40) to a desired article of the user's clothing wherein, the electronic control member (40) is provided with PTT technology, as well as, high noise cut-off (44) directional hearing (48) (48) and selective communication features (42).

27 Claims, 2 Drawing Sheets

BONE CONDUCTING HEADSET APPARATUS

BACKGROUND OF THE INVENTION

CROSS REFERENCE TO RELATED APPLICATIONS

Not applicable.

1. Field of the Invention

The present invention relates to the field of communication apparatuses in general and in particular to a bone conducting headset apparatus specifically designed for military and/or high decibel industrial environments.

2. Description of Related Art

As can be seen by reference to the following U.S. Pat. Nos. 6,456,721, as well as, commercial products offered by Sordin and Gallet, the prior art is replete with myriad and diverse two way communication devices.

While all of the aforementioned prior art constructions are more than adequate for the basic purpose and function for which they have been specifically designed, they are uniformly deficient with respect to their failure to provide a simple, efficient, and practical bone conducting headset apparatus that, while specifically designed for military usage, can also be effectively employed in both commercial and industrial environments that experience high decibel levels. Furthermore, while bone conducting microphones have enjoyed widespread usage in military applications, they have also gained popularity among both firefighters and police officers.

As a practical matter, while the incorporation of bone conducting microphones into military headgear appears to be a logical choice, the unfortunate fact remains that there are many instances wherein, that logical choice can have serious, if not deadly, consequences.

Due to the weight of the modern day military helmet and to the fact that many recent U.S. military engagements have occurred in geographical areas that experience prolonged elevated daytime temperatures, the simple fact remains that the average military man or woman frequently welcomes the opportunity to be free of the burden of their military headgear and associated communications equipment, which includes two headsets, one of which is employed in a low noise environment and the other of which is employed in a high noise environment.

Furthermore, many special forces organizations eschew the use of helmets while conducting military operations in the field, due to their weight and bulk which produce discomfort for the wearer.

As a consequence of the foregoing situation, there has existed, among military personnel in particular, a longstanding need for a new and improved body worn communication equipment that employs a bone conducting microphone that is not integrally coupled with military headgear; and, the provision of such a communication apparatus is the stated objective of the present invention.

BRIEF SUMMARY OF THE INVENTION

Briefly stated, the bone conducting headset apparatus that forms the basis of the present invention comprises in general a headset unit, a microphone/speaker unit, and an electronic control unit that form a lightweight extremely efficient and effective communication system the presence of which is barely noticeable to the user and which allows for clear communication among several individuals even under the most trying of circumstances in battlefield situations, which often involve exposure to both low noise, as well as, high noise environments.

As will be explained in greater detail further on in the specification, the headset unit comprises an adjustable head strap that passes over the user's head and a neck strap that passes behind the user's neck to snugly secure a portion of the microphone/speaker against the bone conducting surfaces on the user's face.

In addition, the microphone/speaker unit comprises a pair of dual speaker/microphone members wherein, each speaker/microphone member has a bone conducting component and an environmental noise component and wherein, the environmental microphone provides a directional hearing capability in an electronic fashion after passing through a digital signal processor in the electronic control unit and then to the bone speaker microphone.

It should also be noted that this invention also contemplates the use of an optional boom microphone that is adapted to be interchangeable between the speaker/microphone members depending upon the personal preferences of the user.

Furthermore, the electronic control unit of this invention employs "push to talk" or PTT technology that allows the user to selectively switch from a listen only mode, an intercom mode, or a push to talk mode depending on the tactical situation with which the particular individual is faced, as well as, the mode of transportation to which the user is subjected such as plane, boat, wheeled or tracked vehicle, etc.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
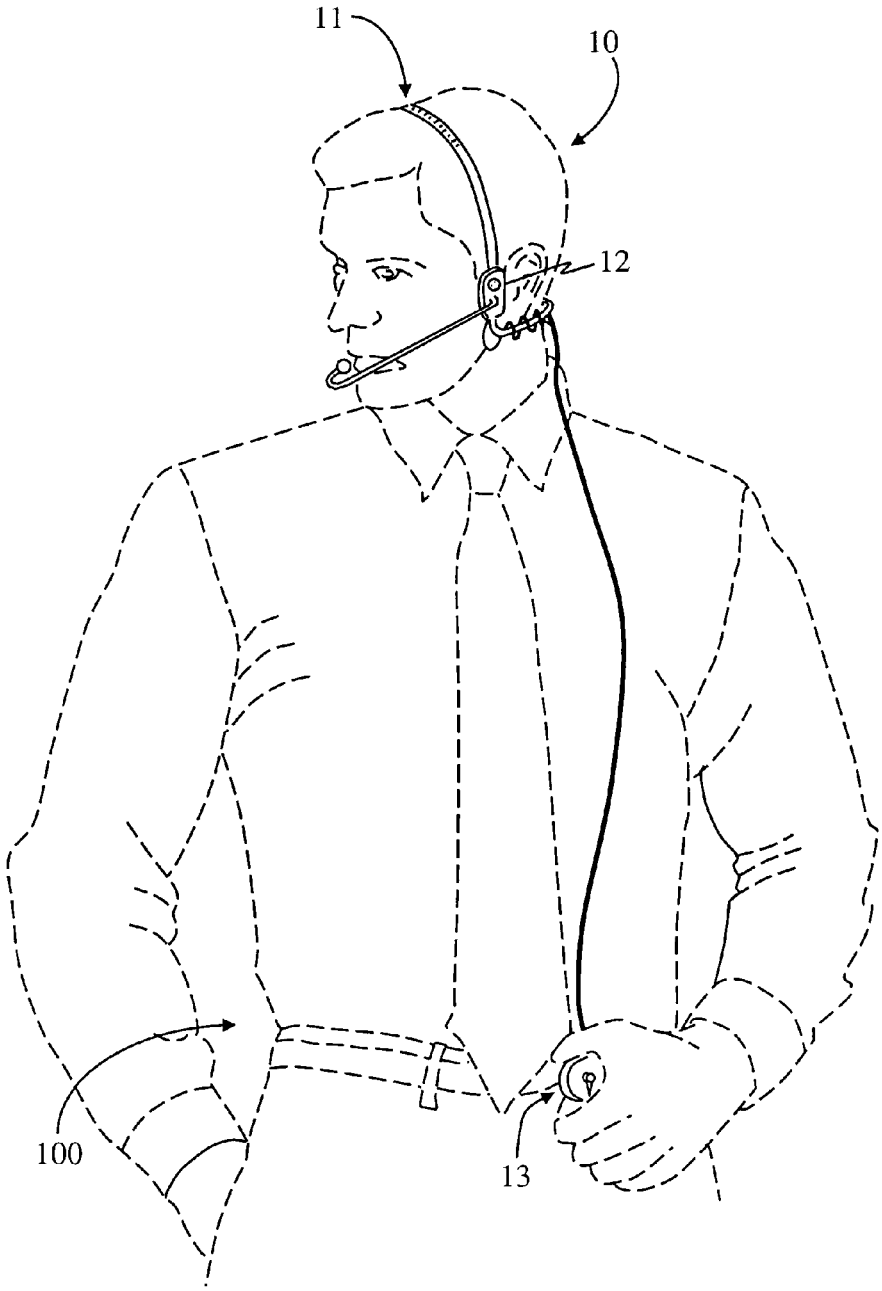
FIG. 1 is a perspective view showing the bone conducting headset apparatus that forms the basis of the present invention in use.

As can be seen by reference to the drawings, and in particular to FIG. 1, the bone conducting headset apparatus that forms the basis of the present invention is designated generally by the reference number 10. The apparatus 10 comprises in general a headset unit 11, a microphone/speaker unit 12, and an electronic control unit 13. These units will now be described in seriatim fashion.

Figure 2:
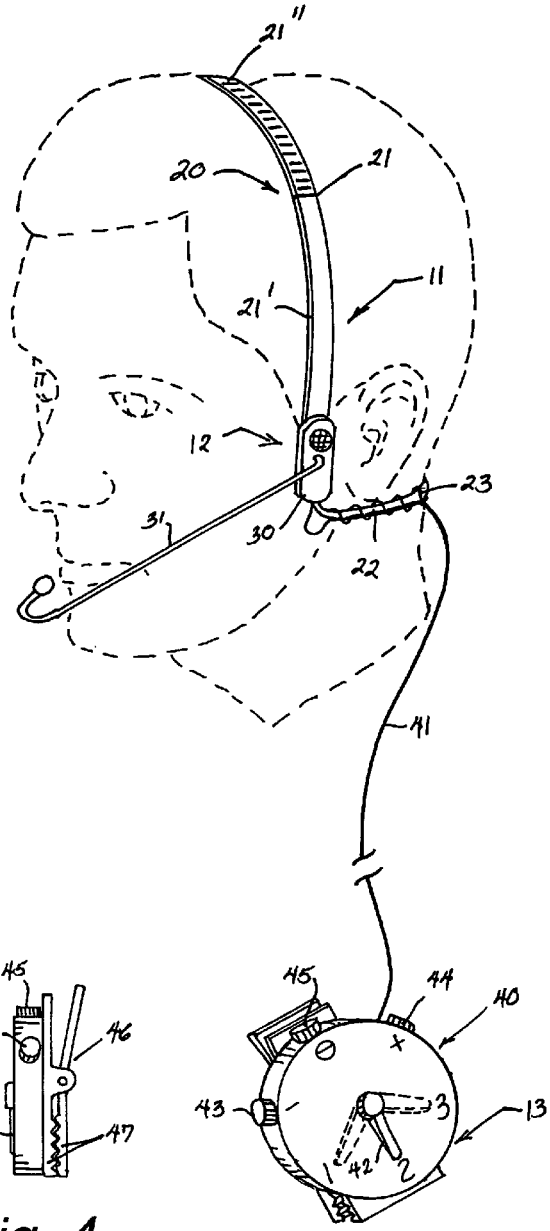
FIG. 2 is an enlarged perspective view of the head set apparatus.
Figure 3:
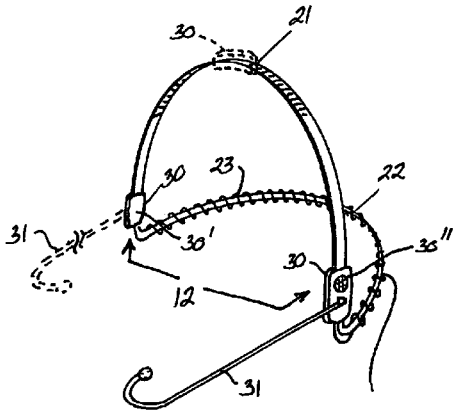
FIG. 3 is an isolated detail view of the head set unit and the microphone/speaker unit; and, FIG. 4 is a side elevation view of the attachment means used to secure the electronic control unit to a desired location on the user's person.

As shown in FIGS. 1 through 3, the headset unit 11 comprises an adjustable spring biased headset member 20 having an adjustable length head strap 21 and a neck strap 22 provided with a spring biasing member 23 whereby the head strap will pass over the crown of the user's head and extend to a location slightly below the user's ears wherein, the opposite ends of the generally U-shaped head strap 21 are operatively secured and disposed generally perpendicular to the opposite ends of the generally U-shaped neck strap 22.

In addition, in the preferred embodiment of the invention depicted in FIG. 2, the adjustable length head strap 21, which includes in a first version, a first head strap portion 21' that is dimensioned to telescopically receive a second head strap portion 21" to vary the effective length of the head strap 21 in a well recognized fashion.

As can best be seen by reference to FIG. 3, the microphone/speaker unit 12 comprises a pair of bone conducting speaker/microphone members 30 30 disposed on the headset member 20 at the junctures between the head strap 21 and the neck strap 22 wherein, a selected one of the speaker microphone members 30 may be optionally provided with a boom microphone element 31 that is selectively interchangeable between the pair of speaker microphone members 30 30. Furthermore, both of the speaker/microphone members 30 30 are also provided with an ambient noise reduction feature which will be explained in greater detail in concert with the description of the electronic control unit 13 which follows.

Still referring to FIG. 3, it can be seen that each of the speaker/microphone members 30 30 has an inner bone conducting component 30' and an outer environmental noise component 30" wherein, the bone conducting component 30' is maintained in operative engagement with the user's head bone via the headset member 20.

As can also be seen by reference to FIG. 3, this invention further contemplates the use of a third speaker/microphone member 30 (depicted in phantom) mounted at the apex of the head strap 21 wherein, the third speaker/microphone member 30 provides an elevational reference signal to the directional hearing capability of the apparatus 10.

Figure 4:
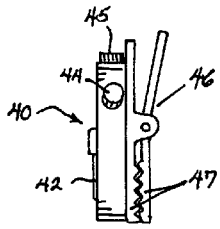

Turning now to FIGS. 2 and 4, it can be seen that the electronic control unit 13 comprises an electronic control member 40 coupled to the pair of speaker/microphone members 30 via either an elongated electrical cable 41 or even a wireless mode.

In addition, the electronic control member 40 is provided with PTT technology wherein, a three position PTT switch 42 that is movable from a first intercom mode, a second listen only mode and a third push to talk or transmission mode.

As can also be seen by reference to FIG. 2, the electronic control member 40 is further provided with conventional ambient noise reduction components wherein, a first dial 43 reduces or filters out the ambient noise in the immediate vicinity of the microphone portions of the speaker/microphone members 30 30 or the information being transmitted through the speaker portion of the speaker/microphone members 30 30.

In addition, a second dial 44 on the electronic control member 40 amplifies the volume of information being transmitted through the microphone portions or received through the speaker portions of the speaker/microphone members 30 30.

Furthermore, the electronic control member 40 is also provided with a second push to talk button 45 that will interact with the electronic control member 40 in a well recognized fashion, connected to a second radio to allow communication over two radios simultaneously.

Turning now to FIGS. 2 and 4, it can be seen that the electronic control member 40 is further provided with an alligator clip 46 wherein, the jaws 47 of the alligator clip 46 are adapted to securely fasten the electronic control member 40 to a desired location on an article of clothing 100 being worn by the user of the bone conducting headset apparatus that forms the basis of the present invention.

At this juncture, it should be appreciated that while all of the components that comprise the apparatus 10 are off-the-shelf articles, including the PTT base box, to date no one has combined these components to produce the communication apparatus 10 that forms the basis of the present invention.

At this juncture, it should be appreciated that the bone conducting headset apparatus 10 that forms the basis of the present invention offers significant advantages in military situations.

First of all, a commander can communicate with all of his troops simultaneously via the electronic control member 40 when the personnel under his command have their PTT switch 42 disposed in the "listen only" position. The "intercom" position allows free communication between the troops and the commander in any type of military transport; and, the "push to talk" or "transmission" position can override the "listen only" mode so that an individual trooper can instantly communicate vital information to his commander when he needs to communicate.

In addition, the ambient noise reduction feature allows individual troopers to place dial 44 at is lowest setting such that any transmissions from their commander cannot be overheard by enemy forces while the commander can set dial 44 to amplify whispered information that my be relayed from his troops.

It should also be noted that the electronic control member 40 of this invention will be provided with a high decibel filter such that very loud ambient noises as from explosions fired or artillery will be prevented from being transmitted to others and degrade the content of the transmitted messages while at the same time providing hearing protection of the individual user in electronic fashion.

Furthermore, the provision of the pair of speaker/microphone members 30 30 on the apparatus provides the listener with a stereo effect directional reference point regarding the incoming fire being directed at a particular individual and/or group of individuals or enemy movements.

The smaller, more comfortable headset apparatus 10 will greatly improve the willingness of the users to wear this headset thereby reducing hearing damage through either the active electronic protection of the microphone/speaker unit 12 and passive earplug protection. The headset design will allow the bone conducting speaker/microphone apparatus to be worn anywhere on the head bone.

The slimness of the headset will allow police and military users interference free use of weapons and head protective gear. Waterproofing of both headset and electronics box will allow use in a maritime environment.

The slimness of the headset will allow unobstructed use of Bio/Chem masks or SCBA as used by firefighters.

The bone conducting speaker/microphone will provide clear, not muffled voice, transmissions when wearing a bio chem or SCBA mask.

In the industrial high noise environment, the headset can be used to communicate with cell phones or personal entertainment devices, e.g., radios, CD players, personal computers, voice command operated devices, etc.

Applications for the invention are police, military, firefighting, industrial, entertainment, aeronautic, scuba, maritime and medical.

Since high noise is the cause of hearing damage which is accumulative over exposed time, the user of this equipment can simply add earplugs for protection and can remove the earplugs when the high noise subsides and can continue to wear the headset for communication purposes (radio, intercom) and low noise amplification e.g., the human voice. The invention claims a high degree of user acceptance and an increased use due to a lightweight and high level of comfort. The removal of the electronic part away from the head further reduces the size of conventional headsets with earmuffs such as made by Sordin, Peltor, Silenta, Bose, and others. It also reduces and removes weight from the head to eliminate gravity related fatigue and transfers it to the body.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In a low noise environment, the apparatus 10 allows the user to have full use of radio and intercom communication functions and low noise amplification while at the same time enjoying natural hearing.

High noise impulse sounds (i.e., explosions) are electronically canceled and transmitted to the inner ear by bone conduction not air conduction, as is done in conventional electronic protection earmuffs.

The cancellation sound wave for high noise is an opposite wave electronically generated and transmitted to the bone conducting speaker which conducts the sound vibration to the inner ear wherein, conventional ear plugs can provide passive noise protection and the apparatus 10 will provide additional electronic protection.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A bone conducting headset apparatus comprising headset unit including an adjustable spring biased headset member including an adjustable length head strap and a neck strap provided with a spring biasing member wherein, the head strap has opposite ends that join the neck strap in a generally perpendicular fashion;

a microphone speaker unit including at least a pair of speaker/microphone members including an inner bone conducting component and an outer environmental noise component disposed at one end of the junctures between the head strap and the neck strap wherein, the at least one speaker/microphone member is disposed in intimate contact with the wearer's head bone; and an electronic control unit including an electronic control member operatively connected to the microphone/speaker unit and further provided with an on/off switch and means for positioning the electronic control member on a selected article of clothing worn by the user.

2. The apparatus as in claim 1; wherein, the electronic control member is further provided at least in part with at least one dial that controls audio amplification and/or audio reduction.

3. The apparatus as in claim 1; wherein, the electronic control member is further provided at least in part with a three position switch having an intercom position, a listen only position and a first push to talk position.

4. The apparatus as in claim 2; wherein, the electronic control member is further provided at least in part with a three position switch having an intercom position, a listen only position and a first push to talk position.

5. The apparatus as in claim 1; wherein, the electronic control member is further provided with high noise cut-off means wherein, noise above a preset decibel level will not be transmitted through the at least one speaker microphone member.

6. The apparatus as in claim 2; wherein, the electronic control member is further provided with high noise cut-off means wherein, noise above a preset decibel level will not be transmitted through the at least one speaker microphone member.

7. The apparatus as in claim 3; wherein, the electronic control member is further provided with high noise cut-off means wherein, noise above a preset decibel level will not be transmitted through the at least one speaker microphone member.

8. The apparatus as in claim 4; wherein, the electronic control member is further provided with high noise cut-off means wherein, noise above a preset decibel level will not be transmitted through the at least one speaker microphone member.

9. The apparatus as in claim 1; wherein, the electronic control member is operatively connected to a pair of microphones for directional hearing.

10. The apparatus as in claim 2; wherein, the electronic control member is operatively connected to a pair of microphones for directional hearing.

11. The apparatus as in claim 3; wherein, the electronic control member is operatively connected to a pair of microphones for directional hearing.

12. The apparatus as in claim 4; wherein, the electronic control member is operatively connected to a pair of microphones for directional hearing.

13. The apparatus as in claim 5; wherein, the electronic control member is operatively connected to a pair of microphones for directional hearing.

14. The apparatus as in claim 6; wherein, the electronic control member is operatively connected to a pair of microphones for directional hearing.

15. The apparatus as in claim 1; wherein, the microphone/speaker unit comprises a pair of speaker/microphone members wherein, both said pair of speaker/microphone members are disposed at the juncture of the head strap and the neck strap.

16. The apparatus as in claim 2; wherein, the microphone/speaker unit comprises a pair of speaker/microphone members wherein, both said pair of speaker/microphone members are disposed at the juncture of the head strap and the neck strap.

17. The apparatus as in claim 3; wherein, the microphone/speaker unit comprises a pair of speaker/microphone members wherein, both said pair of speaker/microphone members are disposed at the juncture of the head strap and the neck strap.

18. The apparatus as in claim 5; wherein, the microphone/speaker unit comprises a pair of speaker/microphone members wherein, both said pair of speaker/microphone members are disposed at the juncture of the head strap and the neck strap.

19. The apparatus as in claim 9; wherein, the microphone/speaker unit comprises a pair of speaker/microphone members wherein, both said pair of speaker/microphone members are disposed at the juncture of the head strap and the neck strap.

20. The apparatus as in claim 1; wherein, the at least one of the speaker/microphone members includes a boom microphone element.

21. The apparatus as in claim 15; further including a boom microphone element that is interchangeable between said pair of speaker/microphone members.

22. The apparatus as in claim 9; wherein, the pair of microphones for directional hearing are incorporated into the pair of speaker/microphone members.

23. The apparatus as in claim 15; wherein, the pair of microphones for directional hearing are incorporated into the pair of speaker/microphone members.

24. The apparatus as in claim 3; wherein, the electronic control member is further provided with a second push to talk button to allow communication over two radios.

25. The apparatus as in claim 4; wherein, the electronic control member is further provided with a second push to talk button to allow communication over two radios.

26. The apparatus as in claim 9 further including a third microphone connected to the electronic control member to provide an elevational component to the directional hearing.

27. The apparatus as in claim 26; wherein, the third microphone is disposed on the headset member.

* * * * *

UNITED STATES PATENT AND TRADEMARK OFFICE

CERTIFICATE OF CORRECTION

PATENT NO. : 7,010,139 B1
APPLICATION NO. : 10/725759
DATED : March 7, 2006
INVENTOR(S) : Kees Smeehuyzen It is certified that error appears in the above-identified patent and that said Letters Patent is hereby corrected as shown below:

Title page,
Item [76], Inventor, should read:
-- Kees Smeehuyzen, P.O. Box 7855,
Delray Beach, FL (US) 33482-7855 --.

Signed and Sealed this

Twentieth Day of June, 2006

JON W. DUDAS
*Director of the United States Patent and Trademark Office*